US006426464B1

(12) United States Patent
Spellman et al.

(10) Patent No.: US 6,426,464 B1
(45) Date of Patent: Jul. 30, 2002

(54) CABLE SECTIONAL ASSEMBLY WHICH HOUSES CONCATENATED ELECTRONIC MODULES

(75) Inventors: Charles D. Spellman, Rocky Hill, CT (US); Donald C. Portofee, Westerly; Thomas S. Ramotowski, Tiverton, both of RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/684,083

(22) Filed: Oct. 10, 2000

(51) Int. Cl.[7] ..... H01B 7/12
(52) U.S. Cl. ..... 174/101.5; 367/20; 367/154
(58) Field of Search ..... 174/101.5; 367/20, 367/154

(56) References Cited

U.S. PATENT DOCUMENTS 2,708,742 A * 5/1955 Harris ..... 367/154
2,837,731 A * 6/1958 Harris ..... 367/154
3,418,624 A * 12/1968 Massa ..... 364/154
3,480,907 A * 11/1969 King ..... 367/154
4,510,588 A * 4/1985 Kruka et al. ..... 367/154
4,685,090 A * 8/1987 Krevor ..... 367/20
4,733,379 A * 3/1988 Lapetina et al. ..... 367/20
4,745,238 A * 5/1988 Kotthaus et al. ..... 174/101.5
5,742,559 A * 4/1998 Marshall et al. ..... 367/20
5,745,436 A * 4/1998 Bittleston ..... 367/20

* cited by examiner

*Primary Examiner*—Dean A. Reichard
*Assistant Examiner*—Adolfo Nino
(74) *Attorney, Agent, or Firm*—Michael J. McGowan; Michael F. Oglo; Prithvi C. Lall

(57) ABSTRACT

A cable sectional assembly houses an electrically concatenated series of electronic circuit modules and has electric hook-up media interspersed between the modules. Each run of interspersed hook-up media is surrounded by a flexible tubular member, which is oversized to allow movement of the hook-up media without restriction under flexing of the assembly. The assembly is a construction and arrangement of two forms of moldingly bonded encapsulations. The first of these forms is made of a hard encapsulant and forms a unitary encapsulation local to each electronic module which (i) encapsulates the circuit module and associated electrical coupling connections between the adjacent end of each individual run of an adjacent interspersed run of media and an electrical terminal of the module, and (ii) is securely bonded to the adjacent marginal end portions of the tubular members which surround the adjacent interspersed runs of hook-up media. The second form is an overmolded annular encapsulation made of a softer flexible encapsulant which fills the annular spaces between the encapsulations of the first form, and which is securely moldingly bonded to the midportion of the tubular member and the adjacent lateral surfaces of the encapsulations of the first form. Both the first and second forms of encapsulations are made of cool curing types of encapsulants.

20 Claims, 2 Drawing Sheets

CABLE SECTIONAL ASSEMBLY WHICH HOUSES CONCATENATED ELECTRONIC MODULES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention relates to a cable sectional assembly which houses a series of concatenated electronic modules, and which allows for the assembly to flex without damaging the connections between the electronic modules and the wires, microwave signal coaxial cables or other forms of electrical hook-up media connecting the modules, and which has strong backbone and integral strength while nevertheless being sufficiently flexible for high flexture applcations.

(2) Description of the Prior Art

Notwithstanding the term "Prior Art" being used in the caption of this subsection, and as a legend in connection with FIG. 1, it is to be understood that the term is not intended to mean or imply that the inventors admit that any technology characterized as an unsuccessful attempt, or that the apparatus depicted in FIG. 1, constitutes a 35 USC §102 anticipation of the present invention.

Naval submarines are provided with radio reception while submerged through the facility of a buoyant cable antenna (BCA) system which consists of a multisectional cable which trails behind the submarine. A predetermined trailing portion of the multisectional cable is buoyant and floats on the surface, including the trailingmost section which is a cable section housing a single-conductor antenna element. As an improvement of the BCA system, a new capability was conceived of inserting a section of the cable line immediately inboard of the single-conductor antenna element section which houses a series of electronically concatenated electronic circuit modules. These modules provide radio electronics functions which enhance and/or augment the BCA system's radio electromagnetic wave pickup capablility.

Prior to the present invention the sections of the BCA line were of a form of construction having the core structure of the cable surrounded by a layer of polyethylene applied as a molten extrusion. However, because polyethylene requires high heat during the extrusion process, it was dismissed as a molding material for fear that electronics molded therein would be damaged by the extreme heat. Accordingly, a room temperature curing compound, namely polyurethane, was looked to for the molding compound.

U.S. Pat. No. 5,606,329 to Ramotowski et al, entitled "Buoyant Cable Antenna", discloses a form of construction of a cable sectional assembly in which a radio electronics package is surrounded by a cured polyurethane and microballon composition.

One prior approach employed in an attempt to devise an operationally satisfactory cable sectional assembly for housing concatenated electronic modules employed hard polyurethane encapsulant being locally distributed around the circuit modules, with a softer an overmolding of a mixture of polyurethane and buoyant particulates distributed between the modules and around the hook-up media, as shown in the prior art FIGS. 1 and 1A. In this construction the polyurethane and buoyant particulate mixture was molded into direct contact with the items of hook-up media between modules. This approach was abandoned because it was found that assemblies fabricated in this way exhibit a plurality of problems which are basically related to the flexing of the wires, microwave coaxial cables, or other forms of electrical hook-up media potted within the mixture.

More specifically, during testing of a construction of cable sectional assembly fabricated in accordance with this prior approach to devise the assembly, problems arose as the cable was flexed around a 12-inch diameter mandrel which simulated the intended operational environment in which the assembly would be deployed and retrieved by a 12-inch power capstan. The continuity of the electronic modules and their hook-up media became intermittent, eventually forming an open circuit. It was discovered that the flexing of the cable sectional assembly had caused the connections of the hook-up media with the electronic modules to fracture at the soldered joints which formed the electrical coupling connection at the juncture between each end of a hook-up medium and a terminal of the adjacent electronic module. As may be seen in FIG. 1A, the hard polyurethane encapsulant and the molding of a mixture of polyurethane and buoyant particulates hold the electrical hook-up media in fixed relationship to the electronic modules as the cable sectional assembly is flexed. The junctures between the ends of the hook-up media and the terminals of the modules become stressed, causing fractures of the soldered connections along the length of the assembly.

While the following patents do include cable designs directed for underwater use as well as cable antennas, none of these patented constructions solve the defects discussed above.

U.S. Pat. No. 1,557,049 to Hammond, Jr. discloses a buoyant electrical antenna. The electrical antenna of Hammond includes an assembly which uses a rigid tubular member extending from an underwater device to the water surface. A single conductor running through the center of the rigid member is used which then extends into a flexible casing having a cylindrical shape with a cavity for encasing the single conductor. Insulating standoffs are used to maintain proper spacing of the single conductor relative to the outside wall of the cylindrical flexible member. The single conductor is insulated and obtains its buoyancy through the use of the flexible cylindrical member being filled with air.

U.S. Pat. No. 4,011,540 to Farr discloses a combined electret hydrophone and transmission line which comprises a plurality of coaxial cable segments coupled by electronic circuit modules, wherein the coaxial cable segments serve as seismic detectors, signal transmission, lines and power supply lines. The coaxial cables of Farr use polytetrafluoroethylene ("PTFE") as an integral part thereof for the dielectric material between two conductors. Accordingly, the PTFE used is a part of the coaxial cable provided in Farr, but there is no cavity in which a coaxial cable can loosely fit and independently flex so as to avoid high stress occurring at points of Farr's coaxial cables' connections with the electronic circuit modules. Therefore, it is probable that in high flexibility applications, the cable of Farr would not maintain constant transmission capabilities since high stress points would develop and would thereby cut off transmission where the stress points lead to joint fracture. Further, the PTFE layer used in Farr is not firmly bonded at its outer surface to the remaining layer of the coaxial cable thereby causing a weaker assembly to be formed. Still further, Farr's cable assembly is constructed to have a neutral buoyancy, not a positive buoyancy.

U.S. Pat. No. 4,183,010 to Miller discloses a pressure compensating coaxial line hydrophone and method for detecting mechanical vibrations. The coaxial line includes a coaxial electric cable transducer which includes a combination of an electret with a polymer material having piezoelectric properties. The electret and polymer material are separate flexible materials radially stacked within the cable and preferably constitute a single material formed to have both electret and piezoelectric properties. One polymer which is useful as the piezoelectric material is polyvinylidene fluoride. Similar to Farr, Miller uses PTFE as a dielectric layer between two conductors and not as a protective cable conduit internal to a buoyant cable. In addition, the outer surface of the PTFE layer of Miller's invention is not etched so as to securely bond with surrounding materials. Again, Miller suffers from the defect in Farr in that flexing of the cable could lead to the formation of high stress points at the connection of the cables with electronic equipment. As a result, it appears that intermittencies in proper functioning of the coaxial line hydrophone would occur if the line were to be used in an operational environment involving severe flexing.

U.S. Pat. No. 4,336,537 to Strickland discloses a bi-directional underwater communication system. The system provides a submerged operator with the capability to communicate with a surface site. A face-mask-mounted microphone and an earphone are connected to a submerged, watertight radio. The radio antenna is carried by a buoy to the surface of the body of water in which the operator is submerged. While Strickland uses a cable assembly, it does not specify any special construction thereof. Accordingly, it is believed that the cable between the surface and the underwater vehicle will be a standard coaxial cable, with no special design modifications and which does not integrate any electronics therein. In addition, Strickland does not disclose the use of a conduit in which the cable is encased and which conduit is surrounded by a buoyant material. In fact, the patent to Strickland does not disclose the use of any protecting tubing for protecting the coaxial cable in any form.

U.S. Pat. No. 4,634,804 to Spalding discloses a streamer cable with protective sheaths for a conductor bundle. A fish-net plastic sheath having oppositely layered, generally parallel plastic filaments is used to cover a conductor wire bundle at points where it could otherwise rub against wire rope strain members of the cable. The filaments are joined at all crossing points to provide an expansible and contractible generally tubular construction that can be readily fitted over the cable bundle during assembly. The sheaths prevent the wire rope strain cables in the streamer section from rubbing directly against the conductor wires and causing interruptions in the insulation and shorts. An unspecified plastic wire mesh is used over the wire bundle to prevent the wire rope strain cables from moving directly on the cable wires. The mesh is expandable and constricts around the wire bundle when in place. Accordingly, free movement of the cables is not allowed since the mesh constricts the cables which may cause the formation of high stress points, and thus fracture.

U.S. Pat. No. 4,694,436 to Gelfand discloses a noise-attenuating streamer-cable bulkhead for use in an oil filled seismic cable assembly. The bulkheads reduce internal acoustic noise in the cable assembly by using baffles. Each bulkhead consists of an annular body with conical surfaces converging at a desired angle, extending outwardly from both ends of the annular body. An axial hole and a plurality of off-axial holes extending through the bulkhead are provided for receiving therethrough, electrical conductors and stress members, respectively. Noise traveling within the tube in a waveguide mode, impinges upon the conical surfaces of the cascaded bulkheads, and is reflected out of the streamer-cable jacket. In Gelfand, no electronic circuit boards or other forms of electronic modules are used, and due to the bulkheads the electrical conductor bundle are not free to move in the plastic jacket, thereby creating potentially damaging stress points.

There exists a need, therefore, for a cable sectional assembly of the type having a function of housing electronic modules, and which allows for the hook-up media interconnecting the modules to be flexible independent of the flexing of the remaining portions of the sectional assembly so as to prevent high stress points and resulting fractures of the electrical coupling connections and the junctures between the ends of the hook-up media and the electronic modules.

SUMMARY OF THE INVENTION

The primary object of this invention is to provide a cable sectional assembly of the type which houses a series of electrically concatenated electronic circuit modules, which has improved breakage protection for wires, microwave coaxial cables or other forms of electrical hook-up media interconnecting the modules.

Another object of this invention is to provide a cable sectional assembly of the type housing electronic modules as aforesaid which further has protective oversized conduits for enclosing said hook-up media for allowing flexibility of the hook-up media without damaging connections.

Still another object of this invention is to provide a cable sectional assembly of the type housing electronic modules and having conduits which enclose hook-up media as aforesaid, wherein there is further provided secure bonding between the conduits and the rest of the assembly.

A yet another object of this invention is to provide a cable sectional assembly of the type housing electronic modules and having conduits which enclose hook-up media as aforesaid, whose construction and arrangement endows the assembly with a high degree of backbone strength.

A yet another object of this invention is to provide a cable sectional assembly of the type housing electronic modules and having conduits which enclose hook-up media as aforesaid, which further is bodified by a construction and arrangement of composite molded encapsulations which endow the assembly with sound integral strength while nevertheless being sufficiently flexible for high flexing applications.

Yet further objectives of this invention are to obtain each of the foregoing objectives, with each respective one of the foregoing objectives achieved in a way that makes the assembly buoyant.

The foregoing objects and following advantages are achieved by the provision of a cable sectional assembly housing a series of electrically concatenated electronic modules which have electrical hook-up media interspersed therebetween. In the illustrative embodiment presently proffered, the electronic modules, or electronic structures, housed in the assembly are provided in the form of electronic circuit board assemblies which are sized to be contained within the diametric dimensional envelope of the cable (which is a diameter of approximately 0.65 inches). The hook-up media generally comprises a mix of insulated conductor wires and microwave coaxial cable lines. Each interspersed hook-up media is housed in a flexible tubular member, with the end portions of each individual run of a medium projecting out of the end of the tubular member's bore. Each end of each medium is joined to a terminal of the adjacent electronic module by means of a connection which provides reliable electrical coupling, such as a soldered connection. The tubular elements are oversized allowing flexibility of the hook-up media (i.e., a bundle of wires and microwave coaxial cables) without damaging connections. Each electronic module is potted in a hard local encapsulation, which forms a unitary encapsulation that further encapsulates the soldered electrical coupling connections at the junctures between each end of a hook-up medium and a circuit board terminal. The hard encapsulation further extends to and forms a moldingly bonded joint with the marginal end portions of the outer surfaces at the adjacent ends of the adjacent tubular elements. Softer more flexible overmolded annular encapsulations fill the annular spaces around the midportion of each tubular element between where the hard encapsulations are bonded to the tubular member's marginal end portions. A protective outer jacket, or sheath is fitted over the encapsulations. Freedom of movement of the hook-up media within the tubular members is enhanced by choice of the tubing to be made of a flouropolymer material, such as PTFE (sold under the brand name TEFLON®), and also by coating each individual electrical hook-up medium with such flouropolymer material.

The details of the present invention are set out in the following description and drawings wherein like reference numerals depict like elements.

DESCRIPTION OF THE PREFERRED EMBODIMENT

Figure 2:
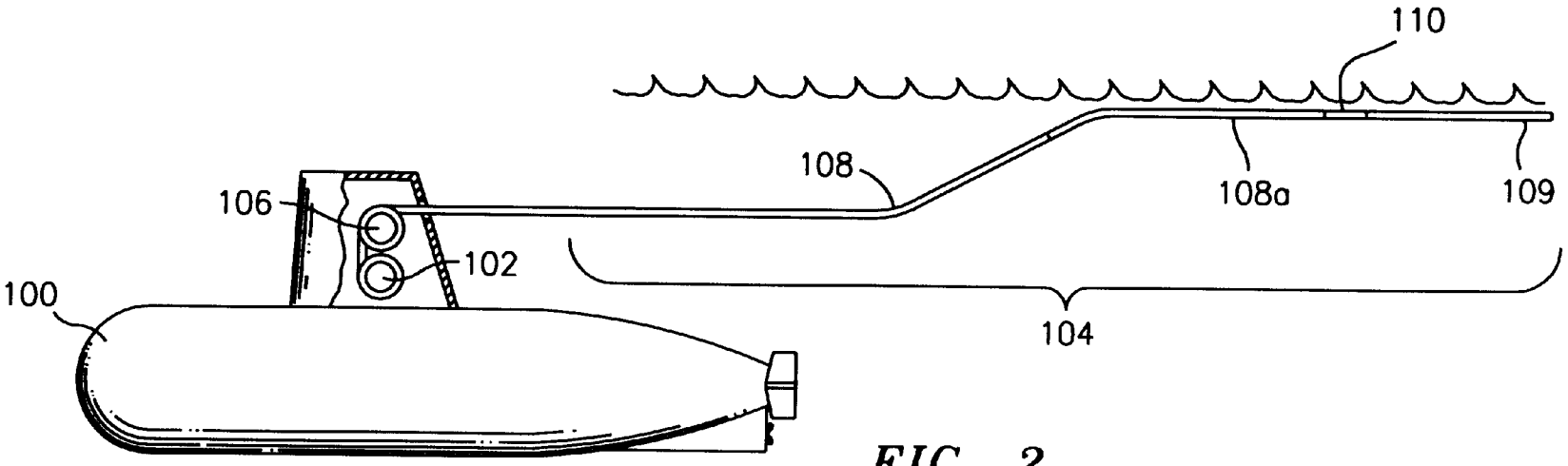
FIG. 2 is a diagrammatic of a multisectional buoyant cable antenna (BCA) line trailing behind a submarine, which has as one of its sectional components an antenna system enhancement cable sectional assembly 110 of the type housing concatenated electronic modules.

Referring now to the drawings and in particular to FIG. 2, a submarine 100 is equipped with a buoyant cable antenna (BCA) system by which it receives radio transmissions while submerged. As part of the BCA system there is provided a spool 102 which reels a deployable multisectional antenna and antenna towing cable line 104. Also aboard the submarine is a 12-inch diameter power driven capstan 106, which operates in the well known manner to deploy, and retract, multisectional cable line 104 from and back to spool 102. At the inboard end of multisectional line 104 is a non-buoyant radio frequency (r.f.) signal lead-in and tow cable section 108. Coupled to the outboard end of cable section 108 is buoyant r.f. lead-in and tow cable section 108*a*. In the operational deployment of line 104, a majority of cable section 108*a* floats on the surface of the sea. At the outboard end of multisectional line 104 there is a buoyant single-conductor antenna cable section 109. This comprises a flexible conductor sheathed in an electromagnetic (e.m.) wave transmissive medium, which when streaming on the surface of the sea picks up e.m. wave radio signals desired by operators in submarine 100.

Figure 4:
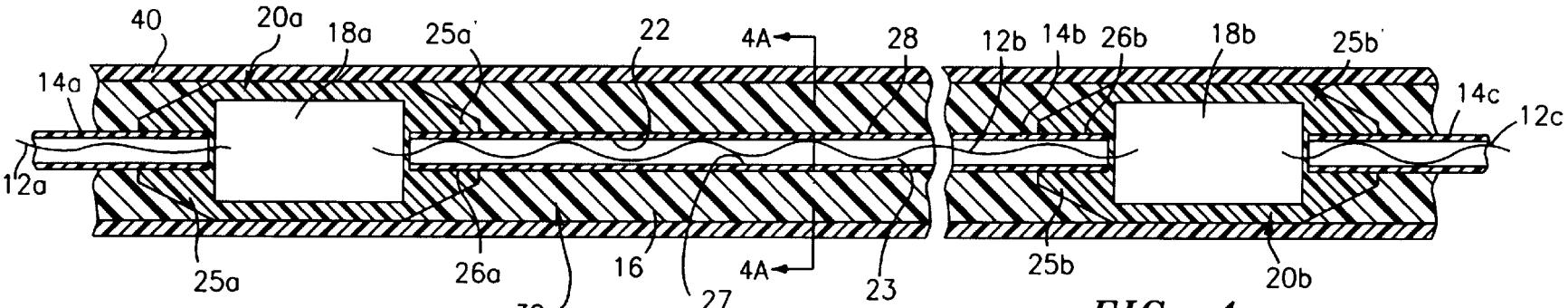
FIG. 4 is a cross-sectional view like that of FIG. 1, but descriptive of a construction and arrangement in accordance with the present invention.
Figure 4A:
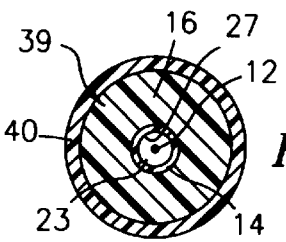
FIG. 4A is a transverse cross-sectional view taken along line 4A—4A of FIG. 4.
Figure 3:
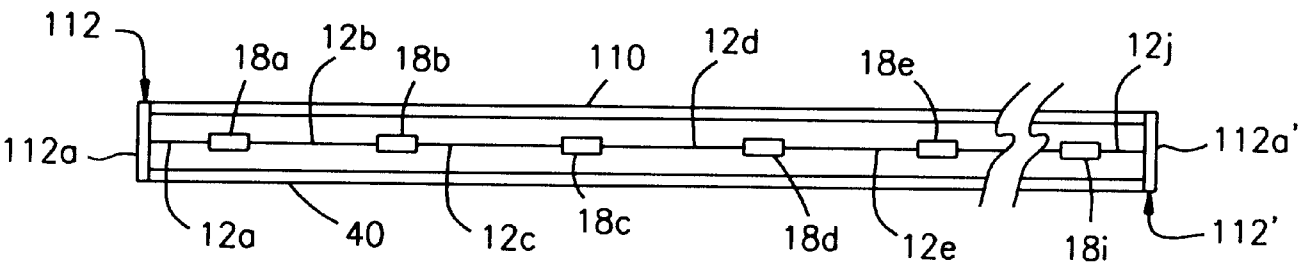
FIG. 3 is a schematic of cable sectional assembly 110 of FIG. 2.

Between buoyant r.f. lead-in and tow cable section 108*a* and single-conductor cable antenna 109 there is provided an antenna system enhancement sectional assembly 110 which houses concatenated electronic modules 18, FIGS. 3 and 4, which enhance the electromagnetic (e.m.) wave reception capability of the BCA system. In the present illustrative embodiment of assembly 110, the electronic modules, or electronic structures, housed within assembly 110 are provided in the form of electronic circuit board assemblies which are sized to be contained within the diametric dimensional envelope of the cable, which is approximately 0.65 inches. The design and fabrication of circuit boards of this size is performed in a known fashion. In general it is the mechanical, structural and materials technology aspects of assembly 110 which constitute the illustrative embodiment of the present invention. Generally, electronic operation of and system functions provided by the electronic structures are not pertinent to these aspects of the invention. However, a few of the circuit modules incorporate an individual antenna element (not shown) for picking up electromagnetic waves, and therefor in the illustrative embodiment of a BCA system enhancement sectional assembly there is a further requirement that the layer or layers of encapsulating and sheathing materials of the structure of the cable which surrounds the electronic modules be transmissive of the electromagnetic waves. (Among U.S. Navy Department engineers involved in the development of buoyant cable antenna systems, and users of such systems, cable sectional assembly 110 is sometimes referred to simply as a "BCA".)

Referring now to FIG. 3, at the end of antenna enhancement sectional assembly 110 there are provided subassemblies 112 and 112' of two-part mechanical and electrical cable couplers, which subassemblies are respectively mateable with coupler subassemblies (not shown) provided at the adjacent ends of r.f. lead-in and tow section 108*a* and of single-conductor antenna section 109. When subassemblies 112 and 112' are mated with the subassemblies at the ends of cable sections 108*a* and 109 they form therewith coupler assemblies which couple one or more electrical communication media. A preferred type of mateable coupler subassemblies for use with the present invention is a Kellems grip-type set of coupler subassemblies, which can be obtained from Hubbel Wiring Devices of Milford, Conn.

Referring now to FIGS. 3 and 4, the electronic structures housed, or embedded, in antenna system enhancement cable sectional assembly 110 comprise a series of electronic circuit board assemblies (or simply "circuit boards") 18*a*, 18*b*, . . . 18*i* uniformly spaced along its length. Runs of electrical hook-up media, (or simply "hook-up runs") 12*a*, 12*b* . . . 12*j* provide electrical communication: (i) between coupler subassembly 112 and electronic module 18*a*; (ii) between adjacent pairs of the series of electronic modules 18*a* . . . 18*i*; and (iii) between electronic module 18*i* and coupler subassembly 112'. In the drawings hook-up media runs 12 are shown as single lines for purposes of clarity of the drawing, but in fact most of the hook-up media runs 12 comprise a bundle of individual media, with each bundle having a mixture of types of media. More specifically, in the illustrative embodiment of BCA system enhancement cable sectional assembly 110: (i) run of media 12*a* between coupler subassembly 112 and electronic module 18*a* comprises one microwave coaxial cable transmission line and at least two insulated single conductor wires (carrying operating potentials for the active electronic circuits of series of electronic modules 18*a* –18*i*); (ii) each of the runs of media 12 interspersed between adjacent pairs of the series of electronic modules 18*a* –18*j* comprise at least one microwave coaxial cable signal transmission line and at least two insulated single conductor wires; and (iii) run 12*j* between electronic module 18*i* and coupler assembly 112' comprises one such coaxial line. However, it is to be understood that the concept of the present invention extends to all known types of electrical hook-up media, including various other forms of high frequency signal transmission lines (i.e., systems of conductors that carry signal power) and various forms of electrical conductor media other than single conductor wires which are used in establishing circuit paths (e.g., stranded wire and multi-conductor cables).

Figure 1:
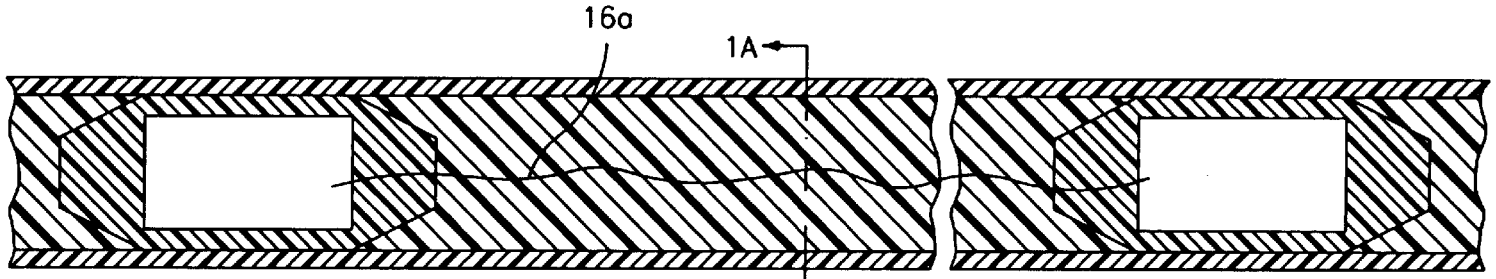
FIG. 1 (PRIOR ART)
FIG. 1 is a schematic cross-sectional view of a longitudinal fragment of a cable sectional assembly 110 of FIG. 2, which is constructed and arranged in accordance with a previous unsuccessful attempt to devise such an assembly.
Figure 1A:
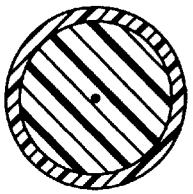
FIG. 1A (PRIOR ART)
FIG. 1A is a transverse cross-sectional view taken along line 1A—1A of FIG. 1.

In the prior unsuccessful approach to devising a cable sectional assembly shown in FIG. 1 and described in the "Description of the Prior Art" subsection hereof, the junctures between hook-up media runs 16*a* and the terminals of the electronic modules have been subjected to great stresses resulting from the flexing of sectional assembly 110 caused by deployment and retrieval by the of small diameter power capstan 106, wave motion, underwater currents, and the like. As a result, connections have broken. In accordance with the present invention, each hook-up media run, for example 12*b* in FIG. 4, is housed within a protective conduit comprising a segment of a hook-up media protective tubular member 14. As will become apparent as this description of the invention processes, presence of tubular member 14 plays an important role in preventing such broken connection.

Referring now to FIGS. 2, 3 and 4, what FIG. 4 depicts is a longitudinal segment of a buoyant antenna system enhancement cable assembly 110 encompassing the region of a successive pair of circuit boards 18*a* and 18*b* of the series of circuit boards 18*a*, 18*b*, . . . 18*i* (FIG. 3). The longitudinal expanse of assembly 110 between coupler subassemblies 112 and 112' is in effect a multi-segmental entity consisting of serially connected segments of the form depicted in FIG. 4.

Referring now to FIG. 4, alone, circuit boards 18*a* and 18*b* are embedded in circuit board protective encapsulations, 20*a* and 20*b*, respectively. Another description term for the encapsulations is "molded body members." A preferred encapsulant out of which encapsulations 20 are formed is polyurethane. Each encapsulation 20 serves to protect the respective circuit board assembly 18 and the individual electrical coupling connections between each end of a hook-up medium and a terminal of the circuit board assembly. These connections are implemented by soldering the end of the medium to a circuit board terminal, or by other methods known in the art of effecting reliable electrical coupling unions. However, for purposes of clarity of the drawing, and because the constructions are so well known, the junctures between ends of individual media and the electrical terminals of the circuit boards, and the soldered connections joining them are not shown. As seen in the drawing, terminal portions of the one and the other opposite ends of hook-up media run 12*b* (and of the component runs of individual media) project outside the respective ends of bore 27 of tubular member segment 14*b*. In accordance with the invention the moldable material used to form each encapsulation 20 is of a type whose curing temperature during molding will be sufficiently low to avoid threat of damaging the electronic circuit board assemblies 18, such as polyurethane which cures at room temperature. In this specification and its appended claims the term "cold curing encapsulant" is intended to mean any encapsulant which cures at temperatures below a temperature which a person skilled in the art would consider as threatening damage to the electronic structure. As shown in the drawing, each encapsulation 20 includes a cylindrical midsection formed about assembly 110's longitudinal axis. Extending from the opposite ends of the cylindrical midsections of encapsulations 20*a*, 20*b* are pairs of frustoconically tapered annular end sections 25*a*, 25*a*' and 25*b*, 25*b*', respectively. These end sections 25*a*, 25*a*' and 26*b*, 26*b*' are annular bodies of revolution which surround and are moldingly bonded to marginal end portions of the adjacent tubular member segments (e.g., end section 25*a*' is bonded to marginal end portion 26*a*, and end section 25*b* is bonded to marginal end portion 26*b*). It will be appreciated that circuit board protective encapsulations 20*a* and 20*b*, as described, form unitary encapsulations which respectively protect circuit boards 18*a* and 18*b* and the associated electrical connections formed across the junctures (not shown) between the respective circuit board's terminals and the adjacent ends of each individual medium of the adjacent hook-up media runs of runs 12*a*, 12*b* and 12*c*. The unitary encapsulations 20*a* and 20*b* further form secure, moldingly bonded joints between: (i) the outer surfaces of tubular member 14's opposite marginal edge portions 26*a* and 26*b*, respectively; and (ii) the surfaces of the central bores of frustoconically tapered encapsulation end sections 25*a*' and 25*b*, respectively. Departures from shaping encapsulations 20 with regular surfaces of revolution (i.e., cylindrical and frustoconical surfaces) may be made to accommodate different preferences in tool and die making. For example, the surfaces of revolution forming the shape of encapsulations 20 could be contoured surfaces of revolution rather than regular surfaces of revolution, so that encapsulations 20 would resemble a footballs. Accordingly, it is to be understood that geometrical terms employed in describing the shape of capsulations 20 in this specification and in its appended claims are intended to encompass this type of departure. As will become apparent as this description of the invention progresses, encapsulations 20 also serve a role in providing backbone strength for assembly 110.

The confronting lateral surfaces of encapsulation end sections 25*a*' and 25*b* of encapsulations 20*a* and 20*b*, (i.e., the confronting frustoconical surfaces of revolution) and the outer surface of tubular member segment 14*b*'s midportion between marginal edge portions 26*a* and 26*b* are overmolded and encapsulated by an overmolded annular encapsulation 16. Another descriptive term for this encapsulation is "annular, buoyant, molded body member." The encapsulant used in casting encapsulation 16 exhibits a significant degree of flexibility and a resilience. This chacteristic is instrumental in allowing assembly 110 to undergo the flexing imposed upon buoyant cable antenna system multisection line 104, FIG. 2 (of which assembly 110 is a part) in the course of operation of capstan 106 and reel 102 and in the actions of the sea when deployed. The encapsulant of which overmolded annular encapsualtion 16 is formed also provides assembly 110 with positive buoyancy which enables assembly 110 to float on the surface of the sea along with the other buoyant sectional components of multisectional line 104. A preferred encapsulant material out of which encapsulation 16 is formed, is glass microballon-filled polyurethane. A preferred mixture of polyurethane and buoyancy producing glass microballon particulates for use in forming encapsulation 16 is disclosed in U.S. Pat. No. 5,606,329 cited in the "Description of Prior Art" subsection hereinabove. This patent is hereby incorporated by reference herein in its entirety. As seen from the drawing, encapsulation 16 fills an annular space whose axial expanse is bounded by the confronting frustoconical surfaces of tapered annular end sections 25*a*' and 25*b* of body members 20*a* and 20*b*. The radial expanse of annular encapsulation 16 extends radially outwardly from the outer surface of the midportion of tubular member segment 14 to a diameter of its cylindrical outer surface equal to the diameter of the cylindrical midsections of encapsulations 20*a* and 20*b*. As in the case of encapsulations 20*a* and 20*b*, the encapsulant employed in casting encapsulation 16 is of the cold curing type to avoid threat of damaging the electronic circuit board assemblies 18.

It will be obvious that if the maximum allowable overall diameter of the cable assembly 110 were not a critical dimensional envelope constraint, the outer cylindrical surface of encapsulation 16 could have a diameter greater than that of the midsection of encapsulations 20*a* and 20*b*. Under these circumstances overmolded annular encapsulation 16 would take the form of a single unitary encapsulation having a longitudinal expanse which extends along the full length of assembly 110 and which surrounds all the circuit board protective encapsulations 20 associated with series of circuit boards 18*a* . . . 18*i*.

There is substantial difference between the hardness characteristics of the encapsulants out of which encapsulations 16 and 20, respectively, are made. Overmolded annular encapsulations 16 are formed of a material having a durometer measured hardness in the range 50–70 on the Shore "A" scale, while encapsulations 20 are formed of a material having a durometer measured hardness in the range 40–60 on the Shore "D" scale. Stated another way, encapsulation 16 have the characteristics of being soft and flexible, whereas encapsulations 20 are very hard and rigid. The high degree of hardness of encapsulations 20 which encapsulate the junctures between the ends of individual runs of media of media runs 12 and the terminals of circuit boards 18, contributes significantly to providing assembly 110 with a high degree of backbone strength to prevent shearing or other fracturing of the electrical connections at these junctures due to stressing thereacross by operation of capstan 106 and reel 102 (FIG. 2) and actions of the sea. The differential between these two ranges of hardness measurements contributes significantly to providing assembly 110 with a combination of strong backbone strength and sound integral strength of the total assembly, while nevertheless being sufficiently flexible for applications involving substantial flexing.

Tubular members 14 are formed of flexible cylindrical tubing. The inner diameter of a member 14 is larger than the thickness dimension of the bundle of wires and/or microwave coaxial cables of hook-up media runs 12. As a result the bore 27 of a tubular member segment 14 forms a cavity 23 within which the individual runs of hook-up media are free to move without any immediate restriction. Further, each bundle of individual runs of electrical hook-up media of span 12 is disposed in the bore of tubular member segment 14 in a spiral fashion yielding strain relief in each individual medium of the runs of hook-up media 12 as the assembly 110 is flexed.

The selection of the material out of which tubular members 14 are fabricated involves two important motivations. Firstly, a tubular member 14 must be sufficiently flexible to undergo the flexing in the course of the capstan driven deployment and retraction of the multisectional cable line 104 of which sectional assembly 110 is a part, and in the course of the severe flexing sectional assembly 110 can experience when deployed in high sea states. Secondly, the friction between the surfaces of the oversize bore 27 of a tubular member 14 and the bundle of hook-up media, which as previously described is free to move therein under flexing of assembly 110, should be minimized. Stating the second motivation to minimize friction another way, the surface energy characteristic of the material used for tubular members 14 should be low. Minimizing friction both relieves tension in the hook-up media thereby avoiding broken connections, and reduces wear of each individual medium of the runs of hook-up media 12 as they pass over the surfaces of bores 27 under flexing of assembly 110. In light of the foregoing motivations tubular member segments 14 are preferably fabricated from polymer compounds of the fluoropolymer family of polymer materials. One suitable fluoropolymer material is polytetraflouroethylene ("PTFE"), which is sold under the brand name TEFLON®. Further, each individual medium of the runs of hook-up media 12 is individually coated with PTFE, or other friction reducing plastic, to further decrease friction and reduce the wear.

However, it has been found that due to the low surface energy exhibited by a fluoropolymer the outside surface 28 of conduit 14 must be chemically altered to enable the formation of secure moldingly bonded joints between surface 28 and encapsulations 20 and 16 in the molding and overmolding processes forming these encapsulations. One technique which provides this desired chemical alteration of the outer surface 28 of conduit 14 is through the use of a fluoropolymer etching product, such as commercially available under the brand name FLUOROETCH®. As the result of this preparation of surface 28 the molding of encapsulations 20 and 16 onto a tubular member segment 14 creates a strong bond therebetween.

In accordance with the invention the combination of: (i) the choice of polyurethane as the preferred molding material for the circuit board protective encapsulation 20, and (ii) the choice of the polyurethane-based mixture of polyurethane load with buoyant particulates as the preferred material for casting overmolded annular encapsulations, is a notable aspect of the invention. The fact that these choices are both in the polyurethane family of molding materials is instrumental in providing secure, moldingly bonded joints between overmolded encapsulation 16 and the confronting frustoconical surfaces of tapered annular end sections 25*a*' and 25*b* of encapsulations 20*a* and 20*b*. This is because when a polyurethane-based material is overmolded onto a polyurethane material a secure moldingly bonded joint is formed therebetween.

The secure moldingly bonded joints between overmolded annular encapsulation 16 and encapsulations 20*a* and 20*b*, between encapsulations 20 and tubular member segment 14, and between overmolded annular encapsulation 16 and tubular member segment 14 contribute significantly to the integral structural strength and durability of cable sectional assembly 110.

It is to be appreciated that the description of cable sectional assembly 110 thus far provided in this specification describes the unencased core 39 of assembly 110.

A durability liner, or protective outer sheath 40, forms the surrounding outermost layer of buoyant antenna cable sectional assembly 110. Sheath 40 is formed of polyolefin, fluoropolymer or other heat shrinkable material. In preparation for insertion of the core structure within the liner and for the shrinking of the liner, a heat activated thermoplastic adhesive tape, such as TTS-250 Hot Melt Tape, manufactured by 3M Company of St. Paul, Minn., is hand wrapped with a small overlap around the exterior surfaces of encapsulations 16 and 20. Application of heat simultaneously shrinks the liner and causes the adhesive tape to melt and flow, forming a taut protective sheath which resists wrinkling when the cable sectional assembly 110 flexes. The wall thickness of sheath 40 is chosen to be sufficiently thick that upon the melting and flowing of the heat-activated adhesive the sheath will produce enough constrictive force to cause uniformity of the exterior surface of assembly 110 throughout its length.

Referring to FIG. 2, in its intended operational mode antenna system enhancement cable sectional assembly 110 is deployed at sea between buoyant r.f. lead-on and towing cable section 108*a* and buoyant single conductor antenna element cable section 109. Some of electronic circuit boards 18*a,* 18*b,* . . . 18*i* perform processing upon signals received by section 109. Others of the circuit boards include in their construction very small discrete antenna elements which in and of themselves pick up electromagnetic wave radio emissions to augment the capability of submarine 100's buoyant cable antenna system. Referring to FIG. 3, the received signals are relayed among circuit boards 18 through microwave coaxial cable hook-up lines within hook-up media runs 12, and the active electronic circuitry of the circuit board assemblies 18 receive their operating potentials through insulated hook-up wires also contained in media runs 12. Since the intended operational environment of sectional assembly 110 is the open sea under all conditions of sea state, assembly 110 is subject to strong currents and wave activity, thereby being tossed about and flexed in a number of unpredictable and sometimes severe manners. Since (i) the tubular conduits 14 are oversized relative to the thickness of the bundles of hook-up media 12 extending therethrough (so that when assembly 110 is flexed the bundles may undergo movement without restriction by the conduits), and (ii) the bundles of hook-up media 12 are spirally disposed in the conduits (so that under assembly 110 being flexed, strain is avoided within the individual media of a bundle), high stress points are avoided at electrical connection junctures between ends of the media and terminals of the electronic circuit boards 18*a,* 18*b* . . . 18*i.* Thus, the soldered, or otherwise obtained electrical unions, between the coaxial cables or wires and the circuit boards are not destroyed. That is, unlike the prior art shown in FIG. 1, the coaxial cables and runs of hook-up media 12 are not frozen in the buoyant surrounding material 16*a.* A large degree of free movement of the individual electrical hook-up media of each media run 12 in cavity 23 is allowed. As a result, the electrical connections across the juncture between microwave coaxial cables, insulated wires, or other forms of electric hook-up media 12 and the electrical terminals of the electronic circuit boards are not sheared or otherwise fractured. In addition the structural stability, strength, and durability of cable sectional assembly 110 is enhanced as the result of: a tubular member segment 14's midportion (i.e., the expanse thereof lying between marginal end portions 26*a,* 26*b*) being securely bonded to the surrounding overmolded, annular buoyant encapsulation 16; the outer circumferential surfaces of marginal end portions 26*a,* 26*b* of tubular member 14*b* being securely bonded to the axially extending inner circumferential surfaces of the central bore in the frustoconical annular end sections 25*a*' and 25*b* of encapsulations 20*a* and 20*b,* respectively; and the annular buoyant encapsulation 16 being securely bonded to the confronting frustoconical surfaces of end portions 25*a*' and 25*b* of body members 20*a* and 20*b.*

The primary advantages of this invention is that a cable sectional assembly 110 is provided which houses longitudinally spaced electronic modules 18 and which allows for the flexibility of the runs of hook-up media 12 interconnecting the modules 18 substantially independent of the other structure of the assembly. Another advantage of this invention is that a cable sectional assembly 110 which forms a housing for a plurality of longitudinally spaced electronic modules 18, is provided having a protective oversized flexible conduit arrangement 14 for enclosing the runs of hook-up media 12 interconnecting the electronic modules, in order to allow flexibility of the hook-up media without damaging the electrical connections between each end of an individual hook-up medium and a terminal of the adjacent electronic module. Still another advantage of this invention is that a cable sectional assembly 110 which forms a housing for longitudinally spaced electronic units 18 is provided having an arrangement of flexible internal conduits 14 for freely enclosing the runs of hook-up media 12 interconnecting the electronic modules, with each conduit of the arrangement securely bonded to the remaining portion of the assembly for increasing the strength thereof. A yet another advantage of this invention is that a cable sectional assembly 110 which forms a housing for longitudinally spaced electronic modules 18 is provided having an arrangement of flexible internal conduits 14 for freely enclosing the runs of hook-up media interconnecting the electronic modules, with a marginal end portion at each of the opposite ends of each conduit securely encapsulated by a hard unitary encapsulation 20 which also encapsulates the adjacent electronic module and the electrical coupling connections at junctures between the ends of individual hook-up media 12 and terminals of the electronic module, in order to provide strong protection of the electrical connection junctures and a high degree of backbone strength to the assembly. A yet another advantage of this invention is that a cable sectional assembly 110 which forms a housing for longitudinally spaced electronic modules 18 is provided having an arrangement of flexible internal conduits 14 for freely enclosing the runs of hook-up media 12 interconnecting the electronic modules, with each conduit 14 encased in a composite structure of encapsulations consisting of (i) first and second very hard encapsulations 20*a,* 20*b.* which encapsulate the respectively adjacent electronic modules 18 and the electrical connection junctures between the ends of each individual medium of the runs of hook-up media 12 and terminals of an electronic module and which become securely moldingly bonded to the marginal end portions 26*a,* 26*b* at opposite ends of conduit 146, and (ii) a third soft and flexible encapsulation 16 which fills the annular space between the pair of very hard encapsulations 20*a* and 20*b* and which becomes securely moldingly bonded to the mid portion of the conduit between its marginal edge portions 26*a,* 26*b* and which. further becomes securely moldingly bonded to the abutting surfaces of the first and second encapsulations, all in order to provide an unencased cord assembly 39 having sound integral strength while nevertheless being sufficiently flexible for applications involving substantial flexing. There is yet a further advantage of this invention consisting of the feature of the layer of annular encapsulations 16 being sufficiently positively buoyant to achieve each respective one of the foregoing advantages in a way that makes cable sectional assembly 110 buoyant, so that assembly 110 is useful for applications requiring buoyant cabling.

Because the invention may be put to use in applications in which assembly 110 can be subjected to tensile strengths in excess of the loading which its construction and arrangement as thusfar described could bear, the inventors contemplate that the best mode of carrying out the invention will employ a set of N high tensile strength fiber strands (not shown) connected between subassemblies 112 and 112', FIG. 3. The number N in the case of a 0.65 inch outer diameter cable structure usually is 3, but as a generality it could be any number equal to or greater than 3. In the illustrative embodiment of BCA enhancement sectional assembly 110 these strands are of an aromatic polymide material, sold under the brand name KELVAR®. The construction and arrangement implementing this best mode will hereinafter sometimes be referred to as the "best mode of the invention involving a unique mode of attachment and channeling of strength strands."

The construction and arrangement implementing the best mode of the invention involves assembly 110's endmost pair of hook-up media protective tubular members 14. The endmost tubular member at left side of assembly 110 (as it is oriented in FIGS. 3 and 4) is tubular member 14*a* (shown only in FIG. 4 where only a fragment of it can be seen). It structurally connects subassembly 112 with circuit board 18*a,* and hook-up media run 12*a* extends through it. The counterpart endmost tubular member at right side of assembly 110 is not shown in the drawing. However, its location can be contemplated by reference to FIG. 3. Had the right side endmost tubular member been shown in FIG. 3, it would contain hook-up media run 12*i* and it would structurally connect circuit board 18*i* with coupler subassembly 112'.

In accordance with this best mode involving a unique mode of attachment and channeling of strength strands, coupler subassemblies 112 and 112' at the opposite ends of assembly 110 are in the form of the hereinabove referred to Kellems grip-type subassemblies (not shown). Before addressing the attachment and channeling of the strength strands relative to other structure of assembly 110, it is desireable to impart an elementary understanding of a Kellems subassembly and how it functions in cooperation with a gripable cylindrical structure at the end of a cable structure. Each Kellems coupler subassembly 112 includes a body member (not shown) and a cylindrical open-mesh-sleeve (not shown). The body member forms the conventional mechanism (not shown) for detachably engaging a mating end of the other subassembly of a two-part Kellems coupler and also forms the conventional electrical connection arrangement which electrically couples electrical communication media across a juncture in a multisectional cable line. The details of the engagement mechanism and electrical connection arrangement are not relevant to this description of a best mode of invention. The open-mesh-sleeve of a Kellems subassembly projects axially inwardly from the inner end of the body member in concentric alignment about the longitudinal axis of assembly 110. The mesh sleeve's axially outer end is attached to the body member and its inner end forms an open mouth. The axially outer marginal end portions (not shown) of the pair of endmost tubular members (14*a,* fragmentarily shown in FIG. 4, and its counterpart at the other end of assembly 110) are each provided with a polyurethane sleeve (not shown) molded onto the circumferential surfaces of their respective axially outer marginal end portions. The length and outside diameter dimensions of the polyurethane sleeve are chosen make it insertable, with a snug fit, into the interior expanse of a coupler subassembly's mesh-sleeve. This construction and arrangement, i.e., the molding of a sleeve over the axially outermost marginal end portion of the endmost tubular members, forms the marginal end portions into gripable cylindrical structures which are inserted into the interior expanses of the mesh-sleeve of the adjacent coupler subassembly (not shown in the drawings). Once the gripable substantially cylindrical structure (details longitudinal grooving is hereinafter described) is inserted in the mesh-sleeve it becomes held in place by gripping action of the mesh-sleeve. This gripping action is initated by sliding friction between the mesh-sleeve and the outer surface of the polyurethane sleeve of the gripable cylindrical structure. Sliding friction is generated in reaction to a tensile stress imparted between the coupler subassembly and the endmost tubular member, and this sliding friction causes the open-sleeve-mesh to constrict and grip the polyurethane sleeve of the tubular member's gripable cylindrical structure in the same way a Chinese finger locking toy works. (Among engineers involved in the development of multisectional cables, and users of multisectional cables, these gripable cylindrical structures are sometimes referred to "grips").

Provided in connection with the construction and arrangement of each endmost tubular member are a set of perforations (not shown) through the tube wall. The perforations are arranged in a ring around the tube's circumference, at an axial location immediately adjacent to the axially inner edge of the gripable cylindrical structure. The number of perforations in the ring of perforations is equal to the number, N, of strands in the set of strength strands (i.e., usually 3 in 0.65 inch cable structures, but as a generality 3 or more). The perforations are equiangularly disposed about the tubular member's axis.

Provided in connection with the construction and arrangement of each gripable cylindrical structure on an endmost tubular member is a set of N longitudinal grooves (not shown). These longitudinally extending grooves are formed in the outer circumferential surface of the polyurethane sleeve. As will become apparent as the description of this best mode progresses, the function of the longitudinal grooves is related to the adjacent ring of perforations in the wall of an endmost tubular member, and the longitudinal grooves are equiangularly spaced around the circumference of the polyurethane sleeve in angular alignment with respective ones of these perforations. The grooves are formed in the known fashion by the design of the impression cavity of the mold (not shown) which is employed in casting the polyurethane sleeve onto an endmost tubular member.

Referring again to FIGS. 3 and 4, it will be appreciated that between coupler subassemblies 112 and 112' there are a series of tubular members consisting of endmost tubular member 14*a,* tubular members 14*b* and 14*c* (FIG. 4) and a remaining subset (not shown) of the series of tubular members 14 whose locations can be contemplated by reference to FIG. 3 as tubular members, which had they been shown, would have contained media runs 12*i*–12*j*. Interspersed between the individual tubular members of this series are the individual circuit boards of series of circuit boards 18*a* . . . 18*j*. Together, the series of tubular members and the series of circuit boards form an array consisting of alternatingly tubular members and circuits boards. The array at both of its ends terminates with endmost tubular members whose axially outer marginal end portions form the gripable cylindrical structures and which have the ring of perforations adjacent the inner ends of the gripable structures.

At a stage in the fabrication of assembly 110's encapsulations 20, and prior to the casting of the polyurethane sleeves of the gripable cylindrical structures onto the endmost tubular members, the array alternatingly consisting of tubular members 14 and circuit boards 18 are constrained in linear alignment in a system of molds and fixtures (not shown). The system comprises a series of longitudinally aligned two-part molds. At the opposite ends of the series are one and another of a pair of molds for casting the polyurethane sleeves about the axially outer marginal end portions of the endmost tubular members (14*a,* fragmentarily shown in FIG. 4, and its counterpart at the other end of assembly 110). Between the pair of molds for forming the sleeves are the remainder of the series of molds consisting of individual molds for forming encapsulations 20 in the localility of each circuit board of series of circuit board assemblies 18*a*–18*i,* FIG. 3. This system of molds supports the all the tubular members 14 (including the endmost tubular members) as inserts of the system of molds, maintaining the tubular members in concentric alignment about the longitudinal axis of the mold and fixture system. It also supports all the circuit boards of the series of circuit board assemblies 18*a*–18*i.*

It is necessary that the molds which form the sleeves upon the axial outward marginal end portions of the endmost tubular members be in radial alignment one to the other about the longitudinal axis of the mold and fixture system. More particularly, the endmost two-part molds at each end of the mold and fixture system for casting the sleeve must have their respective impression cavity elements which form the set of N equaliangularly spaced longitudinal grooves in the sleeves in the same angular positions about the system's longitudinal axis.

It is also necessary in installing endmost tubular members (14*a,* FIG. 4, and its counterpart at the opposite end of assembly 110) as inserts in the mold and fixture system, that their respective rings of N perforations be in radial alignment one to the other and also in radial alignment with the corresponding longitudinal grooves formed in the circumferential surfaces of the sleeves.

The ends of each medium of hook-up media runs 12*a*–12*j* which are adjacent to a circuit board 18 are soldered to an electrical terminal thereof. The axially outer ends of each medium of the pair of endmost media runs 12*a* and 12*j* are conventionally electrically coupled with the electrical connection arrangement of their respective adjacent Kellems coupler subassembly in a known fashion.

Installation of the set of N strength strands into assembly 110 is performed at a stage of fabrication before encapsulant is introduced into the molds of the system of molds and fixtures which will form encapsulations 20. The first sequence of acts in installing the strands is basically a threading operation which may be started at either end of assembly 110. Starting the threading, for example, at the left side of assembly 110 (as it is oriented in FIGS. 3 and 4), the N strands are individually threaded (or channeled) through respective ones of the ring of N equiangularly spaced perforations in the wall of the left-side endmost tubular member 14*a,* into the bore of the tube. The strands are thence threaded (or channeled) through the remainder of the alternatingly disposed (i) tubular members 14 and (ii) the localities of circuit boards 18, finally reaching the counterpart, right-side, endmost tubular member at the right side of assembly 110. There the set of strength strands are individually threaded (or channeled) out of the tube's bore, through the corresponding ones of the ring of N perforations in that endmost member (which as previously described are in axial alignment with the corresponding perforations in the ring of N perforation through the wall of right-side endmost tube 14*a*). The strands pass through the perforations into the space outside the endmost tubular member, at the right side of assembly 110. In they being threaded through the alternatingly disposed tubular members 14 of the array, the set of strands run alongside the bundle of spiraling hook-up media 12 also running through the tubular members. The inside diameters of tubular members 14, which as previously described are oversized relative to the thickness of the contained hook-up media bundles, are in this best mode further selected to be sufficiently oversized relative to the media bundle and the set of parallel running strength is stand to enable both the hook-up media and the strength strands to be free to move without immediate restriction under flexing of assembly 110. In they being threaded through the alternatingly disposed localities of the circuit boards 18 of the array, the strands pass to one or the other sides of the planar structures of the circuit boards. Tail ends of the set of strands are provided outside of the endmost tubular members at each end of the assembly 110. As will become apparent as this description of this best mode involving support by strength strands progresses, these tail ends are important for purposes of binding the set of strands to the adjacent coupler subassemblies 112 and 112', respectively.

Binding the tail end at opposite ends of the set of strands to the respective coupler subassemblies is performed at a stage of fabrication after the polyurethane sleeves have been molded onto axially outward marginal end portions of the endmost tubular members forming the gripable cylindrical structures, and after these gripable cylindrical structures are snugly fitted into the cylindrical interior expanse of the open-mesh-sleeves of the respective coupler subassembly. More particularly, each set of tail ends are bound to the open-mesh-sleeve of the adjacent coupler subassembly. Although the fit between an open-mesh-sleeve and the outside surface of the molded polyurethane sleeve of the gripable cylindrical structure is generally tight, where the shallow longitudinal grooves are present there is sufficient spatial relief between the sleeve mesh and the bottom of the groove to allow the interweaving of a tail-end of a strength strand with the strands of the mesh-sleeve. More particularly the tail ends of the strands are attached to and made fast to their respective adjacent coupler subassembly by in a two-step process. Firstly, the tail ends are individually interwoven with the strands of the adjacent sleeve-mesh along the longitudinal groove at the same angular position where the individual strand passes through a perforation in the wall of the endmost tubular member. This interweaving in an axially outward direction is stopped at an axial position along the open-mesh-sleeve which is a short distance from the coupler subassembly's body member. With standard Kellems grip type subassemblies, this interweaving results in each tail end being alternatingly interwoven above and below about six strands of the open-mesh-sleeve. It is to be appreciated that performance of the this interweaving is possible despite the snug fit between the open-mesh-sleeve and the outer surface of the polyurethane sleeve of a gripable cylindrical structure because of the spatial reliefs provided by the shallow longitudinal grooves. When all the tail ends at both ends of the set of strands are thusly interwoven, the set of strands is drawn taut taking up all slack in the individual strength strands. This includes taking up slack both: (i) outside the endmost tubular members, and (ii) inside the central core structure of assembly 110 consisting of where the strands pass within the alternatingly disposed tubular members 14 and pass around the alternatingly disposed circuit boards 18. At the axial locations at both ends of assembly 110 whereat the interweaving of the individual strands are stopped, the remainders of the tail ends at each respective end of the set are merged and tied together and to an adjacent crossover point in the mesh of the open-mesh-sleeve. A self seizing knot, such as the conventional diamond knot, is employed in making these ties. The knot is permanently sealed by application of epoxy glue and the tail ends are trimmed off close to the knot.

The hard encapsulating material is introduced into the individual two-part molds of the system of molds and fixture and allowed to cure thereby forming encapsulations 20. As previously described, encapsulations 20 envelope the associated connections of the ends of individual hook-up media with circuit board terminals. Further, with the construction and arrangement of the presently described best mode involving a unique attachment mode and channeling of strength strands, encapsulations 20 envelope the segments of the strength strands not within tubular members 14 as the strands pass to one and the other sides of the circuit boards 18. The encapsulation of these segments of the strength strands in the hard encapsulant material of encapsulations 20 results in secure entrainment of the strands at the localities of circuit boards 18 along their expanse.

It is to be appreciated that in the described construction and arrangement of this best mode the gripping action of the open-mesh-sleeves of the coupler subassemblies securely grips the tail ends of the strength strands. This gripping action, together with the secure entrainment of segments of the strength strands in hard encapsulations 20 at the localities of circuit boards 18, effectively attaches the strength strands to other components of assembly 110 in way which augments the assembly's tensile strength capacity.

Earlier hereinabove there is described the softer annular encapsulations 16, FIG. 4, which are overmolded into the annular spaces between encapsulation 20. A pair of similar annular encapsulation (not shown) of the softer molding buoyant material are provided about the endmost tubular members. More particularly each encapsulation of this pair is located between the axially inner edges of the gripable cylindrical structure of the respective endmost tubular member (not shown) and the confronting frustoconical lateral surfaces of the adjacent circuit board encapsulation 20. Stated another way, each soft encapsulation around an endmost tubular member is an annular body of revolution. In the axial dimension, these annular bodies of revolution have an expanse extending axially inwardly from the inner edge (not shown) of the polyurethane sleeve molded around the tubular member's marginal end portion (not shown) to the fustoconical lateral surface of the end section of the adjacent encapsulation 20. The only contact which occurs between the individual strength strands (not shown) and these soft encapsulations (not shown) is along the very short expanses of the strength strands which extend radially along the face of the inner edge of each polyurethane sleeve. In the radial dimension each strength strand has an expanse which extends radially between where the strand passes through a perforation in the ring of perforations through the tube's wall and the outer periphery of said face of the inner edge of the sleeve where the strand turns and extends in an axially outward direction in the longitudinal groove formed in the outer circumferential surface of the sleeve.

An important advantage of the this best mode involving a unique attachment mode and channeling of strength strands is the channeling of the strength strands inside the central core structure of assembly 110, consisting of where the strands pass through alternatingly disposed tubular members 14 and within the alternatingly disposed encapsulations 20 of hard encapsulant material, with the tail ends of the strands passing to the space outside this central core structure containing softer encapsulant material at locations immediately adjacent to where the tail ends are attached. This construction avoids the strength strands having to pass axially through any softer encapsulation (i.e., they neither pass through the pair of soft material encapsulations overmolded around the endmost tubular element at the opposite ends of assembly 110, nor through the overmolded annular encapsulations 16 between encapsulations 20) in a way that would rip and tear the softer encapsulant material under surges of tensile stress or strain in the strength strands.

The invention is not limited to the manufacture of sectional assemblies for buoyant cable antenna towed lines. It also has applicability to other marine or non-marine applications where there is a requirement for locating a plurality of active electronic circuits in a portion of a run of cabling that can be subjected to severe flexing. For example, it has applicability to submerged marine cabling for towing hydrophones and to r.f. lead-in cables for land or aircraft-based radio antenna.

Further, it is to be understood that the invention is not limited to the illustration described and shown herein, which is deemed to be merely illustrative of one preferred mode of carrying out the invention, and which is susceptible of modification. The invention rather is intended to encompass all such modifications which are within its spirit and scope as defined by the claims.

What is claimed is:

1. A cable sectional assembly, comprising:

at least one segment having a pair of spaced-apart electronic structures connected by a flexible tubular member having a bore;

a first encapsulation surrounding and encasing each of said electronic structures;

each said first encapsulation having an end portion which overlaps and contacts a marginal edge portion of an adjacent end of said tubular member;

a second encapsulation surrounding said tubular member and said end portion of each said first encapsulation;

the pair of spaced-apart electronic structures being electrically connected by at least one run of an electric hook-up medium, said at least one run of an electric hook-up medium extending through said tubular member with opposite terminal portions of each run of a hook-up medium of said at least one run projecting outside respective ends of the bore of the tubular member;

each electronic structure of the pair of electronic structures having a plurality of electronic terminals; and an electrical coupling connection at a juncture between each end of a hook-up medium and a terminal of an adjacent one of said electronic structures.

2. The invention of claim 1 wherein said tubular member has an inside diameter which exceeds a thickness dimension of said at least one run of hook-up medium extending therethrough by an amount sufficient to enable the at least one run of hook-up medium to move without immediate restriction under flexing of the sectional assembly.

3. The invention of claim 2 wherein:

said tubular member is made of a material having characteristics which exhibit low surface energy; and each individual run of hook-up medium of said at least one run of hook-up medium is coated with a material which exhibits low surface energy.

4. The invention of claim 2 wherein said at least one run of a hook-up medium is disposed within the bore of the tubular member in a spiral fashion.

5. The invention of claim 1 further comprising each said first encapsulation respectively encapsulating the electrical coupling connections at the junctures between terminals of the respectively encapsulated electronic structures and an end of a hook-up medium, and respectively extending to and forming a moldingly bonded joint with an outer surface of said marginal edge portion of the tubular member.

6. The invention of claim 5 further comprising:

said first encapsulation being comprised of a first encapsulant;

said second encapsulation being comprised of a second encapsulant which at least fills an annular space extending radially outwardly from a midsection of the tubular member between marginal edge portions of the tubular member, said annular space being laterally bounded by confronting lateral surfaces of the first encapsulations and being radially bounded by a protective tubular sheath surrounding said spaced-apart electronic structures and said flexible tubular member; and said first encapsulant being harder than said second encapsulant.

7. The invention of claim 6 wherein:

said cable sectional assembly further is buoyant; and said second encapsulant is loaded with buoyancy producing particulates.

8. The invention of claim 7 wherein said second encapsulant comprises polyurethane loaded with glass microballoons.

9. The invention of claim 6 wherein said first and second encapsulants are both polyurethane-based materials.

10. The invention of claim 6 wherein said first and second encapsulants are both of the cool curing type.

11. The invention of claim 6 wherein said first encapsulant has a durometer measured hardness in the range 50–70 on the Shore A scale and said second encapsulant has a durometer measured hardness in the range 40–60 on the Shore D scale.

12. The invention of claim 6 wherein said tubular member is made of fluoropolymer material and has its outer surface chemically altered to strongly bond with the first and second encapsulants.

13. The invention according to claim 1 wherein said tubular member is made of flurorpolymer.

14. The invention of claim 1 wherein each at least one run of a hook-up medium includes a run of an electrical wire which s employed in establishing an electrical circuit path.

15. The invention of claim 1 wherein each at least one run of a hook-up medium includes a run of a system of conductors forming a transmission line for high frequency signals.

16. The invention of claim 15 wherein said transmission line is a microwave coaxial transmission line.

17. The invention of claim 1 wherein said at least one run of a hook-up medium comprises a bundle of at least two runs of hook-up media.

18. The invention of claim 1 further comprising a protective sheath surrounding the at least one segment.

19. The invention of claim 1 wherein each said electronic structure is a circuit board assembly.

20. A cable sectional assembly, comprising:

a linear multisegmental structure at least three segments comprising a first central segment, and second and third side segments to one and the other side of the first segment;

each segment comprising two spaced-apart electronic structures structurally connected by a flexible tubular member;

each segment further comprising a first encapsulation surrounding and encasing each of said electronic structures, said first encapsulation having an end portion which overlaps and contacts a marginal edge portion of an adjacent end of said tubular member, and a second encapsulation surrounding said tubular member and said end portion of each said first encapsulation;

the electronic structure of the spaced-apart electronic structures of the first central segment disposed toward the second side segment and the electronic structure of the spaced-apart electronic structures of the second segment disposed toward the first central segment being one in the same;

the electronic structure of the spaced-apart electronic structures of the first central segment disposed toward the third side segment and the electronic structure of the spaced-apart electronic structures of the third side segment disposed toward the first central segment being one in the same;

the spaced-apart electronic structures of each segment being electrically connected by at least one run of a hook-up medium extending through the connecting tubular member with its opposite terminal portions projecting outside the respective ends of a bore of the tubular member;

said electronic structure having at least one electrical terminal; and an electrical coupling connection at a juncture between each end of a hook-up medium and a terminal of the electronic structure adjacent to said each end of a hook-up medium.

* * * * *